US011024986B2

(12) United States Patent
Watzek et al.

(10) Patent No.: US 11,024,986 B2
(45) Date of Patent: Jun. 1, 2021

(54) CABLE CONNECTOR FOR ELECTRIC PARKING BRAKE ACTUATOR

(71) Applicant: Johnson Electric International AG, Murten (CH)

(72) Inventors: Michael Watzek, Courgevaux (CH); Vincent Zanini, Cudrefin (CH); Michael Kaeser, Dudingen (CH)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 0 days.

(21) Appl. No.: 16/504,186

(22) Filed: Jul. 5, 2019

(65) Prior Publication Data

US 2020/0014133 A1 Jan. 9, 2020

(30) Foreign Application Priority Data

Jul. 6, 2018 (GB) ..... 1811146

(51) Int. Cl.
*H01R 4/48* (2006.01)

(52) U.S. Cl.
CPC ..... *H01R 4/48* (2013.01)

(58) Field of Classification Search
CPC ..... H01R 4/48; H01R 4/4845; H01R 4/4818; H01R 4/4809; H01R 13/5833; H01R 2201/10; H01R 2201/26; H01R 9/00; H01R 9/24; H01R 43/027; H01R 4/5083; H01R 13/187; F16H 63/3466; B60T 13/74
USPC ..... 439/751, 438, 441, 729, 834, 786, 816, 439/861, 862
See application file for complete search history.

(56) References Cited

U.S. PATENT DOCUMENTS 2,705,785 A * 4/1955 Benander ..... H01R 24/76 439/441
3,609,642 A * 9/1971 Norden ..... H01R 9/2416 439/441
4,169,645 A * 10/1979 Faulconer ..... H01R 43/28 439/392
4,772,218 A * 9/1988 Ross ..... H01R 4/4818 439/387
4,920,456 A * 4/1990 Pirdzuns ..... A47L 9/2868 361/822
5,423,699 A * 6/1995 Johnson ..... H01R 4/5091 439/783
5,871,369 A * 2/1999 Obayashi ..... H01R 12/774 439/331
7,287,999 B2 * 10/2007 Holterhoff ..... H01R 4/4836 439/441
7,329,143 B2 * 2/2008 Schrader ..... H01R 4/4827 439/441

(Continued)

*Primary Examiner* — Travis S Chambers
(74) *Attorney, Agent, or Firm* — Millman IP Inc.

(57) ABSTRACT

A cable connector assembly for an electrical device, which includes a cable connector having a pressing-member receiver, the pressing-member receiver including an electrically-conductive contact or a receiver for an electrically-conductive contact and an opposed wall portion. A cable having a cable terminal which is positionable on the cable connector in contact with the electrically-conductive contact is provided as well. A pressing member, such as a spring element, is provided which is insertable into the pressing-member receiver to contact the wall portion and the cable terminal, the pressing member holding the cable terminal against the electrically-conductive contact.

20 Claims, 5 Drawing Sheets

(56) References Cited

U.S. PATENT DOCUMENTS

| | | | | |
|---|---|---|---|---|
| 7,331,826 | B2 * | 2/2008 | Usui | F16D 55/226<br>439/680 |
| 7,833,047 | B2 * | 11/2010 | Pizzi | H01R 4/4827<br>439/441 |
| 7,993,156 | B2 * | 8/2011 | Holste | H01R 4/4836<br>439/441 |
| 8,342,891 | B2 * | 1/2013 | Fukushi | H01R 4/4836<br>439/752 |
| 8,466,367 | B2 * | 6/2013 | Reibke | H01R 4/4827<br>174/135 |
| 2008/0020628 | A1 * | 1/2008 | Kikuchi | H01R 13/113<br>439/441 |
| 2010/0081316 | A1 * | 4/2010 | Eppe | H01H 71/08<br>439/441 |

* cited by examiner

CABLE CONNECTOR FOR ELECTRIC PARKING BRAKE ACTUATOR

CROSS REFERENCE TO RELATED APPLICATIONS

This non-provisional patent application claims priority under 35 U.S.C. § 119(a) from Patent Application No. 1811146.8 filed in United Kingdom on Jul. 6, 2018.

FIELD

The present disclosure relates to a cable connector assembly, preferably but not exclusively for a vibrationally-sensitive electrical device. There is also provided an electric parking brake actuator having such a cable connector assembly, and a cable connector for a vibrationally-sensitive electrical device which can be used as part of the assembly. A method of connecting a cable to a terminal of a vibrationally-sensitive electrical device is also provided.

BACKGROUND

For electrical devices, to provide an electrical connection between two components, there must be an electrical pathway therebetween, typically by inclusion of an electrically conductive element between the two components. This could be provided as either a printed circuit connection affixed to a solid substrate, such as a circuit board, or as a solid connection interface, such as a pluggable coupling, but it is also possible to provide a wired connection between components.

For most applications, the disadvantages of the wired connection make it a less desirable option; the engagement of the wire with the components is an additional step in the manufacturing process which increases the complexity and cost of the electrical device. However, in applications where there is a high risk of vibration, the wired connection may be preferable.

A wired connection, formed as a cable which extends between two terminals, is able to damp any vibrations of the electrical device, rather than transmitting force to the points of weakness in the system, which would typically otherwise be the points of contact between the connector and the components to be connected. For solid systems, the vibration might cause damage to the solder, or might cause dislodging of the physically attached components. This is particularly true for applications in which there are moving parts, and in particular those having damped connectors to an associated housing to mitigate the effects of vibrations. One such electrical device might be an electric parking brake actuator, which traditionally has an electric motor mounted therein which is coupled to the housing via an elastic member, to permit small lateral movements to damp the effect of vibration on the motor.

At present, a connector is provided which couples to the terminals of the motor for the electric parking brake actuator, and each cable is provided with a crimped shoe or sleeve for the cable terminals, which can be plugged into place in the connector. This provides a resilient connection.

The difficulty with this arrangement is that the attachment of the cable having the crimped shoe to a corresponding terminal is performed manually; the flexibility of the cable makes automation of the assembly more complex and therefore more prone to failure. Manual assembly is slow and expensive, and therefore is an inefficient step in the manufacture of an electric parking brake actuator.

SUMMARY

The present disclosure seeks to provide a connection mechanism for a vibrationally resistant cable connector which allows for automated assembly.

According to a first aspect of the disclosure, there is provided a cable connector assembly for an electrical device, the cable connector assembly comprising: a cable connector having a pressing-member receiver, the pressing-member receiver including an electrically-conductive contact or a receiver for an electrically-conductive contact and an opposed wall portion; a cable having a cable terminal which is positionable on the cable connector in contact with the electrically-conductive contact; and a pressing member insertable into the pressing-member receiver to contact the wall portion and the cable terminal, the pressing member holding the cable terminal against the electrically-conductive contact.

If a pressing member can be utilised to urge a cable terminal into position against an electrically-conductive contact, this may eliminate the need for the provision of crimped cable shoes to be attached to the connecting cables. As such, the entire process for the insertion of the cables into the connector can now be automated, since the crimping process was the manual step which was time-inefficient.

Preferably, the pressing member may be a spring element, such as a V- or U-shaped spring.

The use of a spring element, having a spring force which can act laterally within the pressing-member receiver, can advantageously create a simple mechanism for retaining the cable terminal in position against the electrically-conductive contact, and a spring element may also serve to improve an electrical contact therebetween, if made from a conductive material.

The cable connector may further comprise a cable guide at or adjacent to the pressing-member receiver, the cable being at least in part receivable within the cable guide.

The provision of a cable guide allows the position of the cable with respect to the pressing-member receiver to be accurately maintained, which will improve the uniformity of connections across different cable connector assemblies made by an automated manufacturing process.

Optionally, the cable guide may comprise first and second cable guide slots which are spaced apart from one another, each of the first and second cable guide slots being sized to captively receive the cable therein.

Throated portions of the cable guide can limit the possibility of displacement of the cable relative to its longitudinal axis, since the cable can be readily pushed into position, but cannot be extracted by strong vibrational forces.

The cable guide may include a cable guide chamber between the first and second cable guide slots.

A chamber, within which the cable body of an attached cable is received, can retain the cable even where there are severe vibrational forces and can further improve the retention of the cable in position.

Preferably, the first and second cable guide slots may be angularly or positionally offset relative one another, preferably so as to be perpendicular to one another.

Angularly offsetting the first and second slots limits the potential for the cable to be vibrated out of the cable guide along an axial direction. The kink in the cable will help to maintain the cable within the cable guide.

The cable guide may comprise a terminal-directing shoulder to direct the cable terminal to the electrically-conductive contact, and the terminal-directing shoulder may preferably have a chamfered surface.

The provision of a dedicated and preferably shaped surface against which the cable terminal may be folded or bent into position limits the likelihood of damage to the cable occurring during the manufacturing process, which can be a greater risk for a high-speed automated manufacturing process.

In one embodiment, the cable may have two said cable terminals, and further comprising a second said cable connector and a second said pressing member for holding the cable terminals against respective electrically-conductive contacts of the cable connectors.

A pair of pressing-member receivers advantageously allows for the attachment of a single cable at both ends, which may be important for the secure interconnection of, for instance, two motor terminals.

The first said cable connector and the second cable connector may preferably be provided as discrete components.

It is advantageous that the cable connectors are separate components, and are preferably not interconnected by a solid or rigid intermediate body. This will allow the cable connectors to potentially move laterally to further improve vibrational damping in a motor application.

The cable guide may be shaped to define a serpentine, U-shaped, or S-shaped path for the cable between the two said pressing-member receivers.

If the cable follows a serpentine or similar path, being held between the spaced apart cable guide portions, the tension of the cable reduces the likelihood of it being ejected in the event of high vibrational forces.

In another embodiment, two said cables may be provided, and further comprising third and fourth said cable connectors and third and fourth pressing members for holding each cable terminal of the cables against respective electrically-conductive contacts of the cable connector.

Optionally, the pressing-member receiver for a first one of the two said cables may be symmetrically arranged with respect to the pressing-member receiver for a second one of the two cables.

A dual cable arrangement may be best suited for four-terminal motor arrangements, which are amongst the most common form of actuators used in electric parking brake applications.

Optionally, the first and third cable connectors may be unitarily formed.

Unitary formation of some of the cable connectors, preferably those that are co-located within, for example, a device housing, may assist with the structural integrity of the device with which the cable connector assembly is associated.

Preferably, the pressing-member receiver may include a pressing-member retaining means for retaining the pressing member therein. Optionally, the pressing-member retaining means may comprise a stop positioned at or adjacent to the pressing-member receiver.

Some form of latch, such as a lip or stop, may be advisable to prevent ejection of the pressing member from the pressing-member retainer. This may be of particular use if a spring element is used, where vibrational forces could potentially rattle the spring out of position if the spring force is damped.

Preferably, a connector body of the cable connector may be formed from a material having a higher coefficient of friction than the pressing member, such as a plastics material.

The formation of the connector body from a plastics material may provide sufficient frictional resistance for the pressing member to contact, so that unintentional ejection from the pressing-member receiver does not occur.

The pressing-member receiver may be formed as a recess within the connector body.

A recess receiver has the advantage of being suitable for a machine to plug a pressing member into position, which is a mechanically simple action. This results in an assembly process which can be made to be extremely efficient, particularly when compared with the manual attachment of the crimped shoes used for existing connector assemblies.

In one alternative embodiment of the disclosure, the pressing member may be formed as a wedging element receivable within the pressing-member receiver.

Instead of using a sprung element, a physical block or wedge which can be inserted into the receiver may result in an equivalent pressing effect.

Optionally, a width of the pressing member in a relaxed state may be in a range of 50% to 150% of a separation between the electrically-conductive contact and the wall portion of the pressing-member receiver.

A pressing member having a width in this range would be compatible with the majority of cable thicknesses which might feasibly be utilised in the present arrangement. For example, for a spring element, it may be advantageous that, in a relaxed state, it has a width which is equal to or greater than the width of the pressing-member receiver, such that there is a viable spring force which can act against the cable terminal, whereas a wedging member may be sized to be approximately the width of the pressing-member receiver minus the width of the cable terminal.

According to a second aspect of the disclosure, there is provided an actuator comprising an actuator housing, a motor having an electrical terminal which is receivable within the actuator housing, and a cable connector assembly as claimed in any one of the preceding claims, the electrical terminal of the motor being electrically connected to the electrically-conductive contact of the cable connector assembly.

Preferably, the pressing-member receiver may be integrally formed with the actuator housing.

To simplify the assembly of the actuator, the pressing-member receiver can advantageously be integrally formed with the housing, reducing the number of components needed to assemble the actuator.

Preferably, the actuator may be an electric parking brake actuator.

An electric parking brake is usually positioned in an area of very high vibration in a vehicle, and therefore the present disclosure is extremely well suited to provide a suitable cable connection for the actuator associated therewith.

According to a third aspect of the disclosure, there is provided a cable connector for an electrical device, the cable connector comprising: a cable connector having a pressing-member receiver, the pressing-member receiver including an electrically-conductive contact or a receiver for an electrically-conductive contact and an opposed wall portion; and a pressing member insertable into the pressing-member receiver to contact the wall portion, the pressing member holding a cable terminal of a cable inserted therein against the electrically-conductive contact.

According to a fourth aspect of the disclosure, there is provided a method of connecting a cable to a terminal of an electrical device, the method comprising the steps of: a] connecting the terminal to the electrically-conductive contact of a cable connector in accordance with the third aspect of the disclosure; b] inserting a cable terminal of a cable into the pressing-member receiver; and c] inserting the pressing member into the pressing-member receiver to urge the cable terminal into contact with the electrically-conductive contact, a force provided by the pressing member between the cable terminal and the wall portion retaining the cable terminal in contact with the electrically-conductive contact.

The insertion of a pressing member into a receiver of a cable connector provides a simple method by which an electrical connection can be effected. In particular, this is a method which can be readily automated, and therefore removes may of the labour-intensive steps ordinarily associated with the use of cable connectors.

Optionally, during step c], the cable terminal may be folded into position by the pressing member.

The use of the pressing member can not only hold the cable terminal in position once in contact with the electrically-conductive contact, but can also simplify the installation process by actively urging the cable terminal into the correct position by the insertion of the pressing member.

BRIEF DESCRIPTION OF THE DRAWINGS

The disclosure will now be more particularly described, by way of example only, with reference to the accompanying drawings, in which.

DETAILED DESCRIPTION

Figure 1:
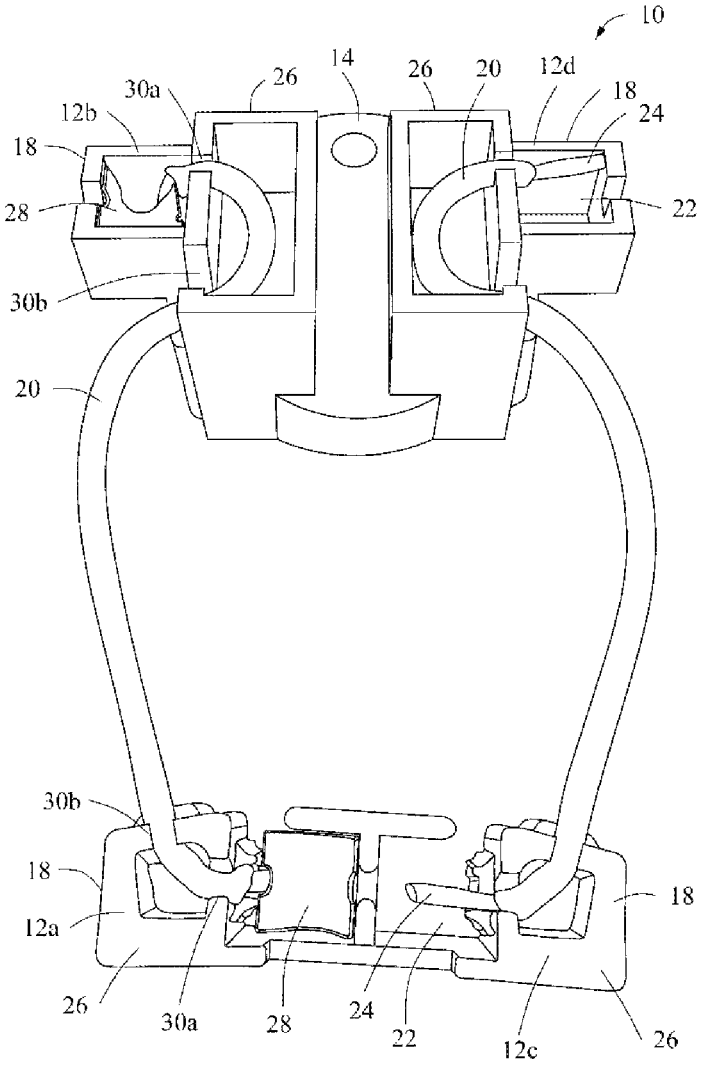
FIG. 1 shows a top perspective representation of a first embodiment of a cable connector assembly in accordance with the first aspect of the disclosure, comprising four cable connectors, and which is suitable for use with an electric parking brake actuator.

Referring to FIG. 1, there is indicated globally a first embodiment of a cable connector assembly, referenced globally at 10, which is suitable for providing an electrical connection between terminals of a vibrationally-sensitive electrical device, such as a motor for an electric parking brake actuator, for example.

The cable connector assembly 10 here comprises a plurality of cable connectors 12*a*, 12*b*, 12*c*, 12*d*, each of which is attachable to or engagable with an associated motor, motor housing, and/or device housing. Here, the second and fourth cable connectors 12*b*, 12*d* are interconnected by a support member 14, which may preferably be positioned so as to align with an associated motor, potentially acting as an end cap thereof. The first and third cable connectors 12*a*, 12*c* may also be interconnected as a unit.

It may be possible, however, that the cable connectors 12*a*, 12*b*, 12*c*, 12*d* are provided as discrete units which may be individually attachable to motor terminals, for instance, or other electrically-conductive terminals of onward connectors.

Four cable connectors 12*a*, 12*b*, 12*c*, 12*d* are provided in the present embodiment, and this is a suitable arrangement for an electric parking brake actuator. First and third cable connectors 12*a*, 12*c* are provided as a unitarily formed piece, and may, for example be provided to connect to onward terminals of the electric parking brake actuator.

The second and fourth cable connectors 12*b*, 12*d* are here formed as discrete and independent units which are respectively connectable to the terminals of a motor of the electric parking brake actuator. As such, the second and fourth cable connectors 12*b*, 12*d* may be positioned so as to be overlayable with the motor within a device housing of the electric parking brake actuator. The isolation of the second and fourth cable connectors 12*b*, 12*d* from one another and also the first and third cable connectors 12*a*, 12*c* provides additional vibrational damping.

Each cable connector 12*a*, 12*b*, 12*c*, 12*d* is preferably provided as at least one, and preferably a plurality of connector bodies 18, here formed as walled chambers which collectively define the areas into which any cables 20 can be inserted to thereby form the complete cable connector assembly 10. There are two types of walled chamber in the present arrangement: a pressing-member receiver 22, here formed as a spring-receiving recess, into which the cable terminals 24 of the cables 20 are insertable; and a cable guide chamber 26, which define a region in which a body portion of each cable 20 is positionable, typically the portion thereof which has not had its insulation layer removed.

Each connector body 18, preferably at least the pressing-member receiver 22 thereof, is preferably formed from a material having a relatively high frictional coefficient, preferably higher than that of a corresponding pressing member, such as a plastics material, particularly if formed via an additive manufacturing process. Each connector body 18 could, however, be formed via a traditional vacuum molding process.

Each cable guide chamber 26 is preferably positioned at or adjacent to a respective pressing-member receiver 22, so as to ensure that an associated cable terminal 24 is aligned correctly for coupling, via a pressing member, which is here formed as a spring element 28 which is receivable in the pressing-member receiver 22.

To hold the body portion of each cable 20 in position, each cable guide chamber 26 preferably includes first and second cable guide slots 30*a*, 30*b* which may be formed as slots in the walls of the cable guide chamber 26 to allow insertion of the cable 20 therein. Preferably, the minimum width of a throated portion of each cable guide slot 30*a*, 30*b* is slightly less than a width of the cable 20 inclusive of the insulation. As such, when the cable 20 is inserted into the first or second cable guide slot 30*a*, 30*b*, the insulation can deform slightly, holding the cable 20 captively in place.

The first cable guide slot 30*a* is positioned at or adjacent to the pressing-member receiver 22, and the second cable guide slot 30*b* is spaced apart therefrom, with a portion of the cable 20 being housed within the corresponding cable guide chamber 26. An improved retention of the cable 20 can be achieved where the first and second cable guide slots 30*a*, 30*b* are positioned at an angle to one another, preferably at an angle of 90° with respect to one another, though alternative offset angles or positions could be considered such that the first and second cable guide slots 30*a*, 30*b* are not coaxial to one another. A perpendicular arrangement may, however, be preferred.

A guide for a single cable 20 may comprise several cable guide chambers 26 which are spaced apart relative to one another, and the second cable guide slots 30*b* of said cable guide chambers 26 may be offset relative to one another such that the cable 20 inserted therein follows a serpentine, U-shaped, or S-shaped path, further improving the retention of the cable 20 in the cable guide.

The spring elements 28 and pressing-member receivers 22 allow for the connection of the cable terminals 24 to associated motor terminals, for example. The connection method is illustrated in FIGS. 2*a* to 2*c* and FIGS. 3*a* to 3*c*. The first cable connector 12*a* is indicated, although the method of connection will be applicable for all of the cable connectors 12*a*, 12*b*, 12*c*, 12*d*.

Figure 2B:
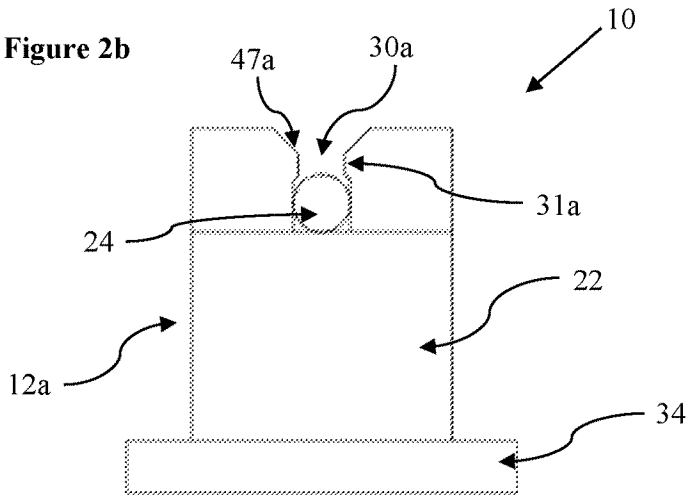
FIG. 2*b* shows a front view of the pressing-member receiver indicated in FIG. 2*a;*
Figure 2A:
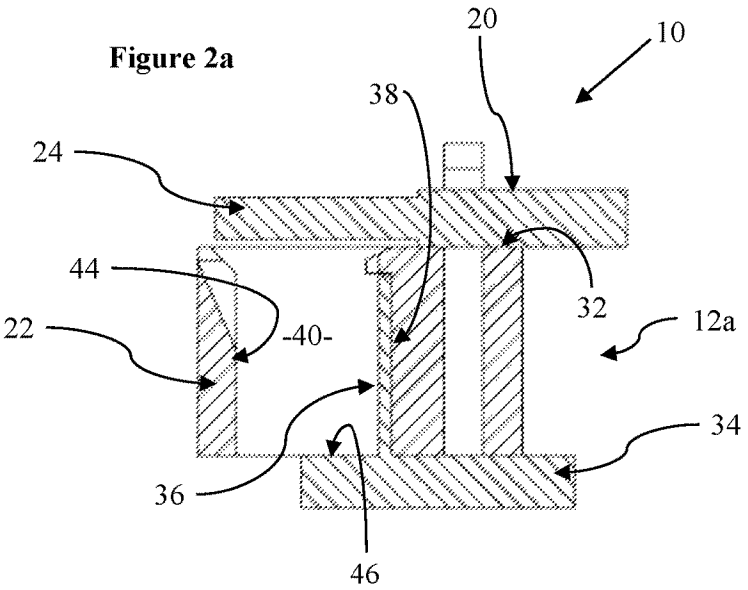
FIG. 2*a* shows a cross-sectional representation through the pressing-member receiver of the cable connector of FIG. 1, prior to insertion of the pressing member.

FIG. 2*a* shows in detail an indicative pressing-member receiver 22 having an unbent cable terminal 24 on an upper surface 32 thereof. Preferably embedded or integrated with a base of each pressing-member receiver 22 is an electrically-conductive element 34 having an electrically-conductive contact 36 to form at least in part a first wall 38 of a spring-receiving recess 40 of the pressing-member receiver 22. To form an electrical connection between the cable 20 and the motor terminal, the cable terminal 24 must be brought into contact with the electrically-conductive contact 36.

The electrically-conductive contact 36 may form the entirety of the first wall 38, or only a portion thereof which is aligned to the cable terminal 24. It may also be possible that the electrically-conductive element 34 is not formed as part of any individual cable connector 12*a*, and instead is insertable into a receiver for an electrically-conductive contact. This may be most applicable where the motor terminals of the associated electric parking brake actuator are formed as insertable stabs or projections of the motor. A stop is provided against which an upper edge of the electrically-conductive contact 36 can abut inside the pressing-member receiver 22, preventing overinsertion of a stab, for example.

An upper surface of the pressing-member receiver adjacent to the cable guide may be formed as a terminal-directing shoulder 42 to direct the cable terminal 24 to the electrically-conductive contact 36, and this preferably has a chamfered surface to prevent accidental damage to the cable terminal 24 as it is bent.

Opposed to the electrically-conductive contact 36 is provided a second wall portion 44, and the electrically-conductive contact 36 and second, opposed wall portion 44 together form the pressing-member receiver 22. A base 46 of the pressing-member receiver 22 may also provide additional support to a pressing member, such as a spring element 28 inserted therein, and in the depicted embodiment, this is advantageously formed by the electrically-conductive element. This may improve a total electrical contact between the cable terminal 24 and electrically-conductive contact 36 via the spring element 28, potentially.

The first cable guide slot 30*a* can be more readily seen in FIG. 2*b*, wherein the slot 30*a* includes a waisted or throat portion 31*a* which retains the vertical position of the cable 20 once pressed into position. An upper, preferably chamfered, surface 47*a* acts as a guide surface which guides the cable 20 into the first slot 30*a*. A dedicated and specific upward force is required to extract the cable 20 through the first cable guide slot 30*a*, since the insulation will need to deform slightly in order for the cable 20 to be removed therefrom. As such, vibrational escape of the cable 20 is rendered improbable.

The second cable guide slot 30*b* is preferably also formed so as to have a similar waisted or throat portion to retain the vertical position of the cable 20 once pressed into position. The upper, preferably chamfered, surface of the slot 30*b* can again guide the cable 20 into the second slot 30*b*.

Figure 2C:
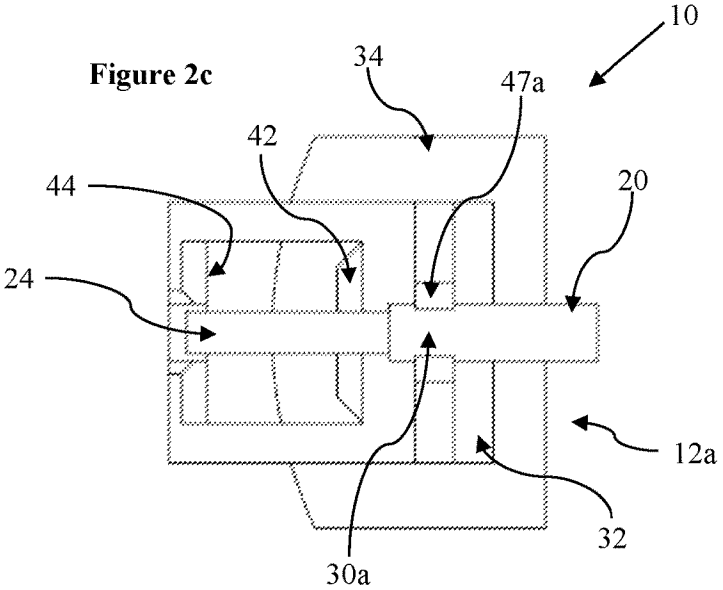
FIG. 2*c* shows a plan view of the pressing-member receiver indicated in FIG. 2*a;*

FIG. 2*c* shows the relative position of the cable terminal 24 and the pressing-member receiver 22. The cable terminal 24 is preferably stripped of insulation so as to span the separation between the electrically-conductive contact 36 and the opposing second wall 44, when positioned in the cable guide. This ensures a maximum contact between the cable terminal 24 and the electrically-conductive contact 36 once the pressing member is inserted, without resulting in a blockage to the pressing-member receiver 22.

Figure 3B:
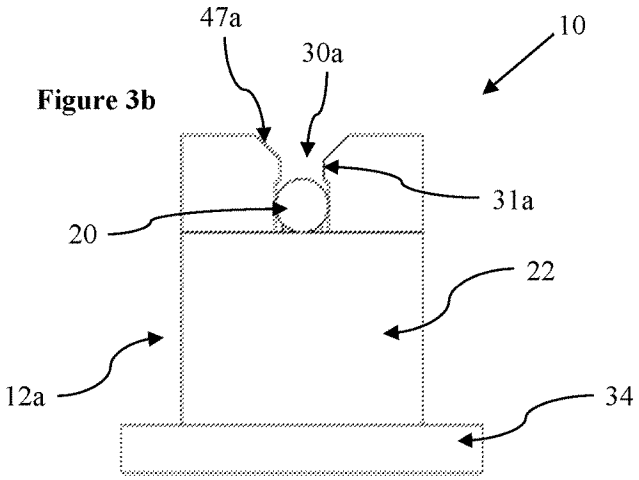
FIG. 3*b* shows a front view of the pressing-member receiver indicated in FIG. 3*a;*
Figure 3A:
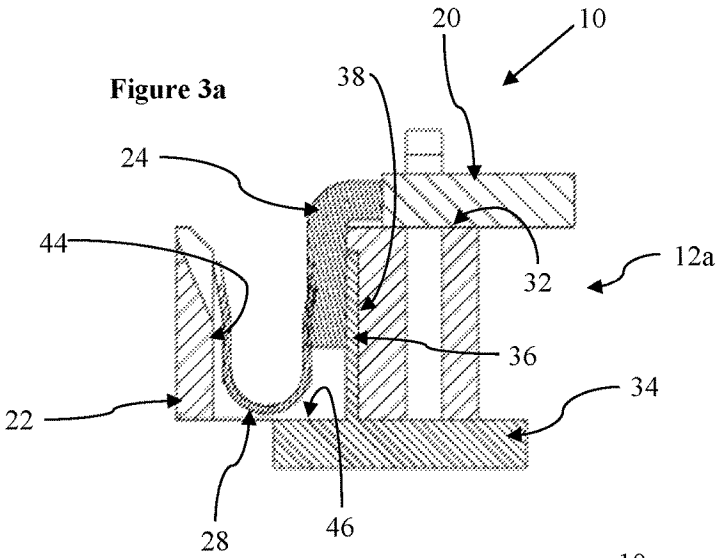
FIG. 3*a* shows a cross-sectional representation through the pressing-member receiver of FIG. 2*a*, following the insertion of the pressing member.
Figure 3C:
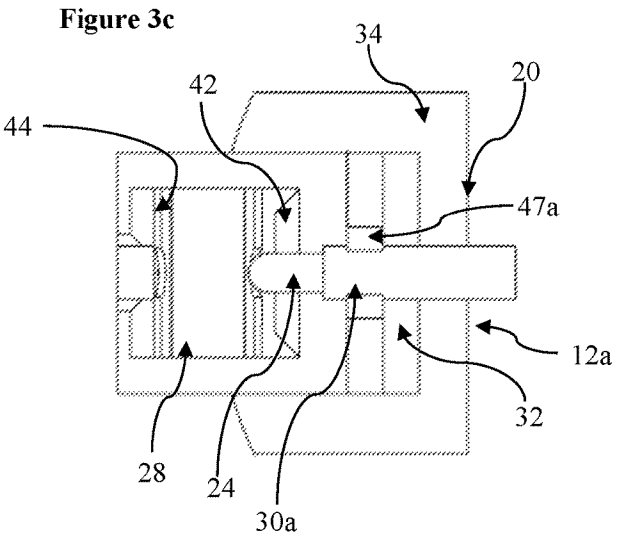
FIG. 3*c* shows a plan view of the pressing-member receiver indicated in FIG. 3*a;*

FIGS. 3*a* to 3*c* show the equivalent representations of FIGS. 2*a* to 2*c* once the spring element 28 has been inserted into the pressing-member receiver 22.

As can be seen in FIG. 3*a*, the spring element 28 is here provided as a V- or U-shaped spring, and preferably has a width, in a relaxed state, of between 90% and 150% of the separation between the electrically-conductive contact 36 and the opposing wall 44. This provides space inside the pressing-member receiver 22 for both the spring element 28 and the cable terminal 24.

The spring element 28 is urged into the pressing-member receiver 22 so as to push the cable terminal 24 down into the pressing-member receiver with the spring element 28. The cable terminal 24 is bent around the terminal-directing shoulder 42 as the spring element 28 comes into contact with the cable terminal 24 during the ingress into the pressing-member receiver 22. The surface of the terminal-directing shoulder 42 may be chamfered to prevent accidental damage to the cable terminal 24 when the cable in inserted into the first slot 30*a*.

This results in a neat folding of the cable terminal 24 against the electrically-conductive contact 36, being held in place as the spring element 28 urges against the cable terminal 24 and the opposing wall portion 44 via the spring force. The more close-matched the size of the spring element 28 to the separation between the electrically-conductive contact 36 and the opposing wall 44, the greater the application of the spring force against the cable terminal 24, and the more secure the holding will be.

FIGS. 3*b* and 3*c* show the positioning of the bent cable terminal 24 from the front and from above, indicating the relative positioning between the cable terminal 24 and the spring element 28.

Figure 4:
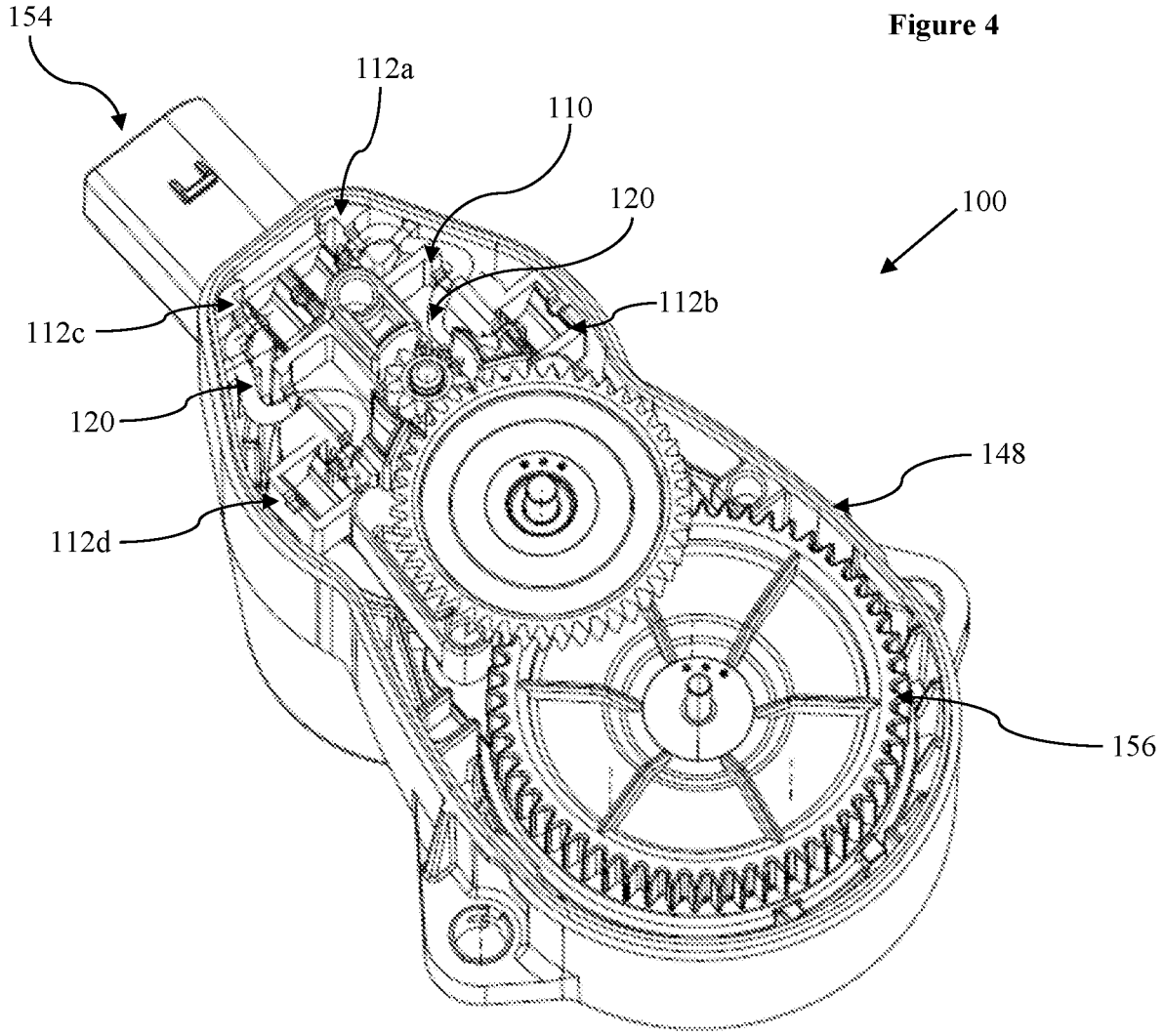
FIG. 4 shows a perspective representation of an actuator utilising a second embodiment of cable connector assembly in accordance with the first aspect of the disclosure.
Figure 5:
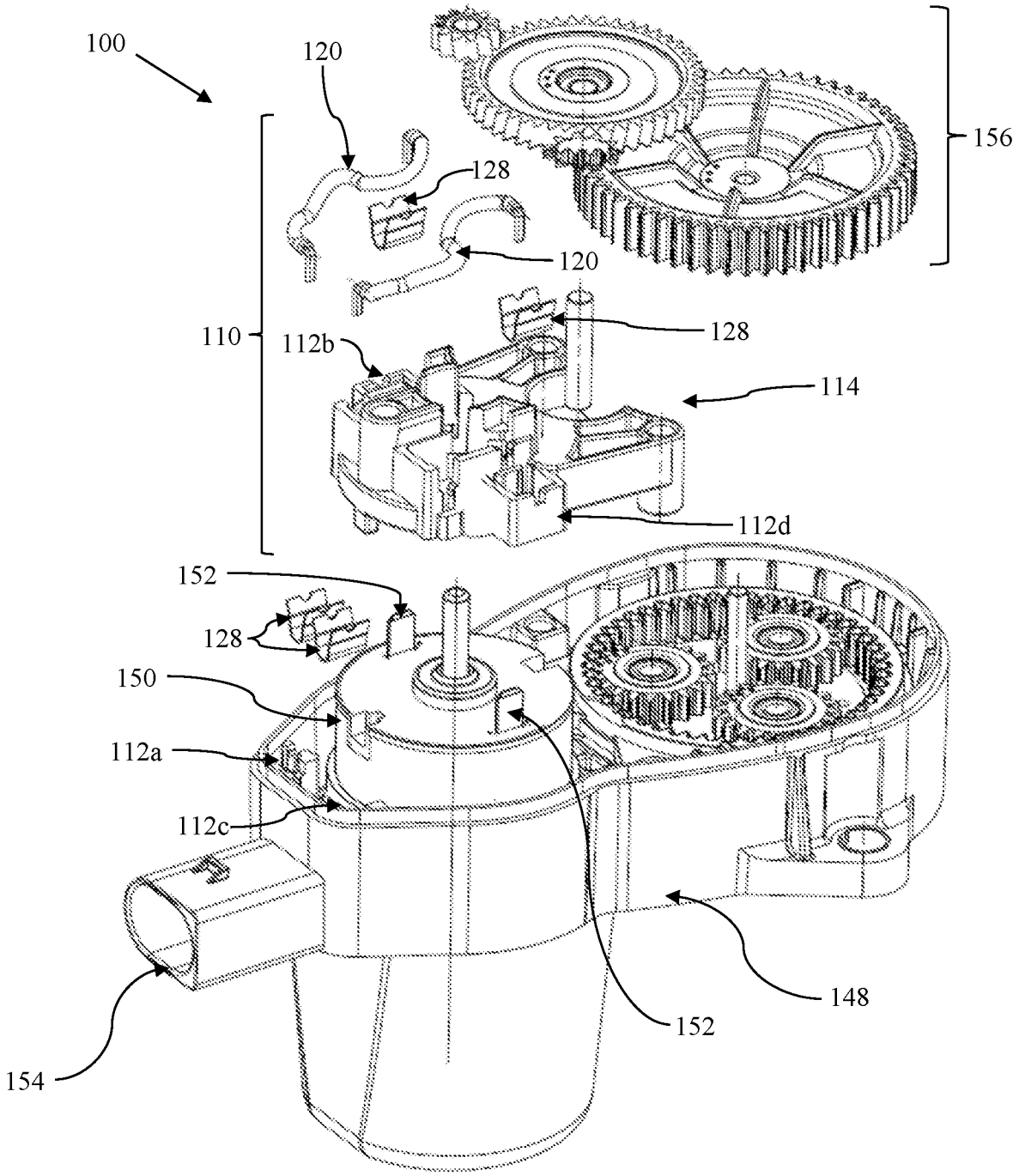
FIG. 5 shows an exploded perspective representation of the actuator of FIG. 4.

FIGS. 4 and 5 show an actuator 100 utilising a second embodiment of cable connector assembly 110, with the indicative position of the cable connector assembly 110 being shown in situ in an actuator housing 148. Identical or similar components of the second embodiment of the cable connector assembly will be referred to using identical or similar reference numerals, and further detailed description is omitted for brevity.

The motor 150 of the actuator 100 is seated within the actuator housing 148, and the cable connector assembly 110 positioned so as to be seatable around the motor 150 such that electrical connection can be made between the motor terminals 152 and other electrical components, in particular, a power supply to the actuator 100. Typically, in an electric parking brake actuator arrangement, the motor 150, preferably provided as a DC motor, is fixed into the housing 148 with elastic suspension, allowing some lateral movement of the motor 150 within the housing 148. The electrical connections must be able to accommodate this lateral movement.

A support member 114 is provided here which is seatable on the end of the motor 150 with the second and fourth cable connectors 112*b*, 112*d* being locatable at or adjacent to the motor terminals 152. However, the first and third cable connectors 112*a*, 112*c* are integrally formed with the actuator housing 148 at or adjacent to a power supply connector 154 of the actuator 100. This may advantageously simplify both the manufacture and assembly of the actuator 100, as the spring elements 128 can be directly engaged with the actuator housing 148. The support member 114 may also be shaped to better accommodate the gears 156 provided with the actuator 100.

Once the support member 114 has been positioned around the motor 150, the cables 120 can be inserted into position, here interconnecting the first and second cable connectors 112*a*, 112*b* and the third and fourth cable connectors 112*c*, 112*d* respectively.

The present disclosure is indicated in FIG. 1 as being suitable for a vibrationally-sensitive electrical device having four terminals, with the cables interconnecting the relevant terminals. However, it will be appreciated that any individual unit of the pressing-member receiver 22 and pressing member to hold a cable terminal 24 in position could be provided, and indeed, a case where only one pressing-member receiver 22 is provided is indicated in FIGS. 2*a* to 2*c* and FIGS. 3*a* to 3*c*. It may, however, be advisable to include at least two said pressing-member receivers 22 in a cable connector assembly 10 for engaging with both cable terminals 24 of a single cable 20.

The pressing member receivers are herebefore described as recesses positioned within walled chambers of the cable connector assembly. However, it will be understood that, provided a pressing member is insertable into a portion of a connector support, regardless of whether there is indeed a recessed portion, it will be possible to captively hold the cable terminal so as to ensure connection with an electrically-conductive contact.

Furthermore, whilst a spring element is proposed as the pressing member, it will be understood that any appropriate element that is capable of imparting a retaining force to the cable terminal in the pressing-member receiver could be considered.

There are several possible alternatives which could be considered. For instance, a rubber or similarly deformable bung could be provided which is insertable into the receiver, effectively wedging the cable terminal against the electrically-conductive contact. This would use a volumetric urging force, rather than a definite spring force, to prevent dislodgment.

Alternatively, a cap element could be provided which is sized to fit into the pressing-member receiver. This could then be physically locked in place, for example, by using a bar or latch across the cap element, or there could be a gripping means on the cap element, such as small teeth which are able to dig into the insulation of the cable and thereby resist ejection from the pressing-member receiver.

Where a non-sprung pressing member is utilised, it is preferred that the size of the pressing member is between 50% and 100% of the separation between the electrically-conductive contact and the opposing wall, so that the pressing member fits into pressing-member receiver, when the width of the cable terminal is accounted for.

The cable connector assembly is indicated above as being one suitable for a vibrationally-susceptible device, such as an electric parking brake actuator, in which a damped DC motor is provided. Since the DC motor has two electrical terminals in this application, it is appropriate that two pairs of cable connectors are provided. However, it will be understood that the number of cable connectors provided should be commensurate with the number of terminals required for connection in the relevant device. For example, a motor may be provided having a ground terminal, in which case a third pair of cable connectors will be required, and stepper motors may have four or more terminals to be connected.

It is therefore understood that the urging of the cable terminal against the electrically-conductive contact is performed with respect to a wall portion which the pressing member can contact. The shape of the pressing-member receiver is therefore, in many regards, immaterial, and could for example, be cylindrical, or non-rectilinear, should a suitably dimensioned pressing member be prepared.

It is therefore possible to provide a cable connector which is suitable for use in an automated assembly line by removal of the need to provide crimped cable shoes. This is achieved by the use of a suitably sized and/or shaped pressing member and pressing-member receiver associated with the connector body which can anchor the cable terminal against its corresponding electrically-conductive contact.

The words 'comprises/comprising' and the words 'having/including' when used herein with reference to the present disclosure are used to specify the presence of stated features, integers, steps or components, but do not preclude the presence or addition of one or more other features, integers, steps, components or groups thereof.

It is appreciated that certain features of the disclosure, which are, for clarity, described in the context of separate embodiments, may also be provided in combination in a single embodiment. Conversely, various features of the disclosure which are, for brevity, described in the context of a single embodiment, may also be provided separately or in any suitable sub-combination.

The embodiments described above are provided by way of examples only, and various other modifications will be apparent to persons skilled in the field without departing from the scope of the disclosure as defined herein.

The invention claimed is:

1. A cable connector assembly for an electrical device, the cable connector assembly comprising:

a cable connector having a pressing-member receiver, the pressing-member receiver including an electrically-conductive contact or a receiver for an electrically-conductive contact and an opposed wall portion;

a cable having a cable terminal which is positionable on the cable connector in contact with the electrically-conductive contact; and a pressing member insertable into the pressing-member receiver to contact the wall portion and the cable terminal for electrical connection, the pressing member holding the cable terminal against the electrically-conductive contact.

2. The cable connector assembly as claimed in claim 1, wherein the pressing-member receiver includes a pressing-member retaining means for retaining the pressing member therein.

3. The cable connector assembly as claimed in claim 1, wherein a connector body of the cable connector is formed from a material having a higher coefficient of friction than the pressing member.

4. The cable connector assembly as claimed in claim 1, wherein the pressing-member receiver is formed as a recess within the cable connector.

5. The cable connector assembly as claimed in claim 1, wherein the pressing member is formed as a wedging element receivable within the pressing-member receiver.

6. The cable connector assembly as claimed in claim 1, wherein a width of the pressing member in a relaxed state is in a range of 50% to 150% of a separation between the electrically-conductive contact and the wall portion of the pressing-member receiver.

7. The cable connector assembly as claimed in claim 1, wherein the pressing member is a spring element.

8. The cable connector assembly as claimed in claim 7, wherein the spring element is a V- or U-shaped spring.

9. The cable connector assembly as claimed in claim 1, wherein the cable connector further comprises a cable guide at or adjacent to the pressing-member receiver, the cable being at least in part receivable within the cable guide, and the cable guide comprises first and second cable guide slots which are spaced apart from one another, each of the first and second cable guide slots being sized to captively receive the cable therein.

10. The cable connector assembly as claimed in claim 9, wherein the cable guide includes a cable guide chamber between the first and second cable guide slots.

11. The cable connector assembly as claimed in claim 9, wherein the first and second cable guide slots are angularly or positionally offset relative to one another.

12. The cable connector assembly as claimed in claim 9, wherein the cable guide comprises a terminal-directing shoulder to direct the cable terminal to the electrically-conductive contact.

13. The cable connector assembly as claimed in claim 9, wherein the cable has two said cable terminals, and further comprising a second said cable connector and a second said pressing member for holding the cable terminals against respective electrically-conductive contacts of the cable connectors.

14. The cable connector assembly as claimed in claim 13, wherein the first said cable connectors and the second cable connector are provided as discrete components.

15. The cable connector assembly as claimed in claim 13, wherein the cable guide is shaped to define a serpentine, U-shaped, or S-shaped path for the cable between the two said pressing-member receivers.

16. The cable connector assembly as claimed in claim 13, wherein two said cables are provided, and further comprising third and fourth said cable connectors and third and fourth pressing members for holding each cable terminal of the cables against respective electrically-conductive contacts of the cable connector, and the pressing-member receiver for a first one of the two said cables is symmetrically arranged with respect to the pressing-member receiver for a second one of the two cables.

17. The cable connector assembly as claimed in claim 16, wherein the first and third cable connectors are unitarily formed.

18. An actuator comprising an actuator housing, a motor having an electrical terminal which is receivable within the actuator housing, and a cable connector assembly as claimed in claim 1, the electrical terminal of the motor being electrically connected to the electrically-conductive contact of the cable connector assembly.

19. The actuator as claimed in claim 18, wherein the pressing-member receiver is integrally formed with the actuator housing.

20. A method of connecting a cable to a terminal of an electrical device, the method comprising the steps of:

a] connecting the terminal to the electrically-conductive contact of a cable connector as claimed in claim 1;

b] inserting the cable terminal of the cable into the pressing-member receiver; and c] inserting the pressing member into the pressing-member receiver to urge the cable terminal into contact with the electrically-conductive contact, a force provided by the pressing member between the cable terminal and the wall portion retaining the cable terminal in contact with the electrically-conductive contact.

* * * * *